US009222650B2

(12) United States Patent
Freier et al.

(10) Patent No.: US 9,222,650 B2
(45) Date of Patent: Dec. 29, 2015

(54) SWITCHABLE LIGHT-DUCT EXTRACTION

(75) Inventors: David G. Freier, Saint Paul, MN (US); Rolf W. Biernath, Wyoming, MN (US); Thomas R. Hoffend, Jr., Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 351 days.

(21) Appl. No.: 13/215,325

(22) Filed: Aug. 23, 2011

(65) Prior Publication Data

US 2012/0057350 A1 Mar. 8, 2012

Related U.S. Application Data

(60) Provisional application No. 61/379,545, filed on Sep. 2, 2010.

(51) Int. Cl.

| | |
|---|---|
| ***F21V 7/04*** | (2006.01) |
| ***F21V 14/04*** | (2006.01) |
| ***F21S 11/00*** | (2006.01) |
| ***F21S 19/00*** | (2006.01) |
| ***F21V 11/08*** | (2006.01) |
| ***F21V 11/12*** | (2006.01) |
| ***F21V 13/04*** | (2006.01) |
| ***F21V 14/08*** | (2006.01) |

(52) U.S. Cl.

CPC ..... *F21V 14/04* (2013.01); *F21S 11/007* (2013.01); *F21S 19/005* (2013.01); *F21V 11/08* (2013.01); *F21V 11/12* (2013.01); *F21V 13/04* (2013.01); *F21V 14/08* (2013.01)

(58) Field of Classification Search

CPC .. G02B 6/0055; G02B 6/0043; G02B 6/0018; G02B 6/0031

USPC ..... 362/600–634

See application file for complete search history.

(56) References Cited

U.S. PATENT DOCUMENTS

| | | | | |
|---|---|---|---|---|
| 4,622,625 | A * | 11/1986 | Becker et al. | 362/304 |
| 7,147,903 | B2 | 12/2006 | Ouderkirk et al. | |
| 7,517,116 | B2 * | 4/2009 | Pfund | 362/260 |
| 2007/0229995 | A1 * | 10/2007 | Kawato et al. | 359/883 |
| 2010/0246158 | A1 * | 9/2010 | Van Gorkom et al. | 362/19 |

FOREIGN PATENT DOCUMENTS

| | | |
|---|---|---|
| WO | WO 2010/075357 | 7/2010 |

* cited by examiner

*Primary Examiner* — William Carter
(74) *Attorney, Agent, or Firm* — Yen T. Florczak

(57) ABSTRACT

The disclosure generally relates to switchable light extractors and in particular to switchable light extractors useful for extracting light from light ducts used for interior lighting of a building. The disclosure also relates to lighting systems that include the light extractors, and methods of extracting light from a lighting system. The switchable light extractors generally include a first and a second reflective film, each having a plurality of voids that can aligned to extract light from a light duct.

23 Claims, 5 Drawing Sheets

SWITCHABLE LIGHT-DUCT EXTRACTION

CROSS REFERENCE TO RELATED APPLICATION

This application claims the benefit of U.S. Provisional Patent Application No. 61/379,545, filed Sep. 2, 2010, the disclosure of which is incorporated by reference herein in its entirety.

BACKGROUND

The long-distance transport of visible light can use large mirror-lined ducts, or smaller solid fibers which exploit total internal reflection. Mirror-lined ducts include advantages of large cross-sectional area and large numerical aperture (enabling larger fluxes with less concentration), a robust and clear propagation medium (i.e., air) that leads to both lower attenuation and longer lifetimes, and a potentially lower weight per unit of light flux transported. Solid fibers include the advantage of configuration flexibility, which can result in relatively tight bends with low light loss. While the advantages of mirror-lined ducts may appear overwhelming, fibers are nevertheless frequently selected because of the practical value of assembling light conduits in much the same fashion as plumbing.

What is needed is a technique to construct efficient low-loss light-ducting systems in a fashion similar to plumbing, or heating, ventilating and air-conditioning (HVAC) ductwork.

SUMMARY

The disclosure generally relates to switchable light extractors and in particular to switchable light extractors useful for extracting light from light ducts used for interior lighting of a building. The disclosure also relates to lighting systems that include the light extractors, and methods of extracting light from a lighting system. The switchable light extractors generally include a first and a second reflective film, each having a plurality of voids that can aligned to extract light from a light duct.

In one aspect, the present disclosure provides a switchable light extractor includes a first reflector including a first plurality of voids and a second reflector including a second plurality of voids, the second reflector disposed facing the first reflector, wherein the first and second reflectors are slidably arranged so that at least one of the first plurality of voids can be at least partially aligned with at least one of the second plurality of voids.

In another aspect, the present disclosure provides a lighting system includes a mirror-lined light duct, a light source disposed to inject light into the light duct, and a switchable light extractor. The switchable light extractor includes a first reflector including a first plurality of voids and a second reflector including a second plurality of voids, the second reflector disposed facing the first reflector, wherein the first and second reflectors are slidably arranged so that at least one of the first plurality of voids can be at least partially aligned with at least one of the second plurality of voids. Further, the switchable light extractor is disposed so that the first reflector faces an interior of the mirror-lined light duct.

In yet another aspect, the present disclosure provides a method of extracting light from a lighting system includes disposing a switchable light extractor into a mirror-lined light duct. The switchable light extractor includes a first reflector including a first plurality of voids and a second reflector including a second plurality of voids, the second reflector disposed facing the first reflector, wherein the first and second reflectors are slidably arranged so that at least one of the first plurality of voids can be at least partially aligned with at least one of the second plurality of voids. The method of extracting light from a lighting system further includes sliding at least one of the first and second light reflectors to at least partially align the first plurality of voids and the second plurality of voids.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings, where like reference numerals designate like elements, and wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Architectural daylighting using mirror-lined light ducts can deliver sunlight deep into the core of multi-floor buildings. Such mirror-lined light ducts can be uniquely enabled by the use of 3M optical films, including mirror films such as ESR film, that have greater than 98% specular reflectivity across the visible spectrum of light. Architectural daylighting is a multi-component system that includes a device for collecting sunlight, and light ducts and extractors for transporting and distributing the sunlight within the building. The typical benefits of using sunlight for interior lighting can include a reduction of energy for office lighting by an average of 25%, improved light quality due to the full spectrum light delivered, and is often more pleasing to office occupants.

One of the components of the light ducting portion of the system is the ability to bend the duct up to 90 degrees or more, to accommodate building features that would prevent a straight run of the duct in the building. Such light duct bends have been described, for example, in co-pending U.S. Patent Application No. 61/297,321, entitled "Light Duct Bend", filed on Jan. 22, 2010. Without the ability to turn the light efficiently via corners or bends in the duct, any architectural daylighting system would be limited to straight ducts only, which could significantly reduce the attractiveness of using sunlight for interior lighting.

Another component of the light ducting portion of the system is the ability to extract light from desired portions of the light duct efficiently, and without adversely degrading the light flux passing through the light duct to the rest of the daylighting system. Without the ability to extract the light efficiently, any architectural daylighting system would be limited to short-run ducts only, which could significantly reduce the attractiveness of using sunlight for interior lighting.

Figure 1A:
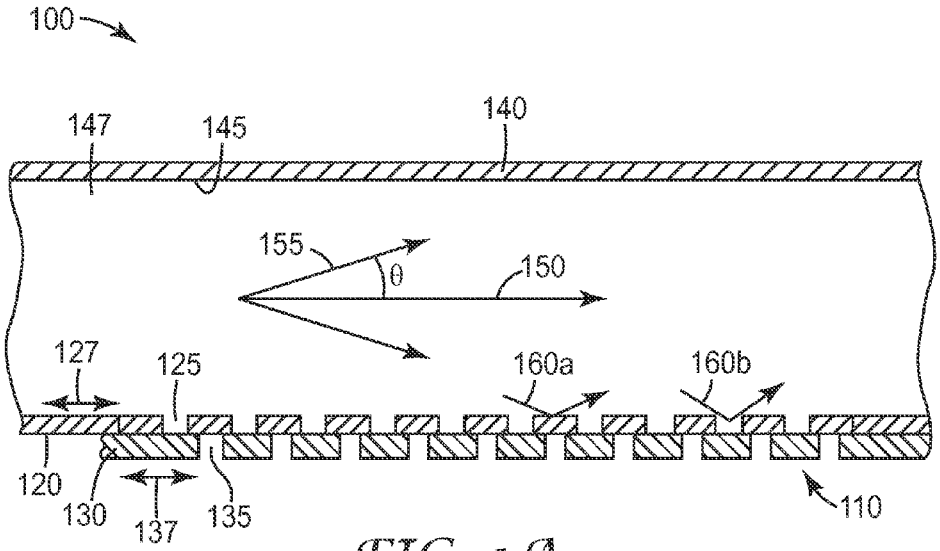
FIGS. 1A-1B shows a cross-section schematic of a light extractor.
Figure 1B:
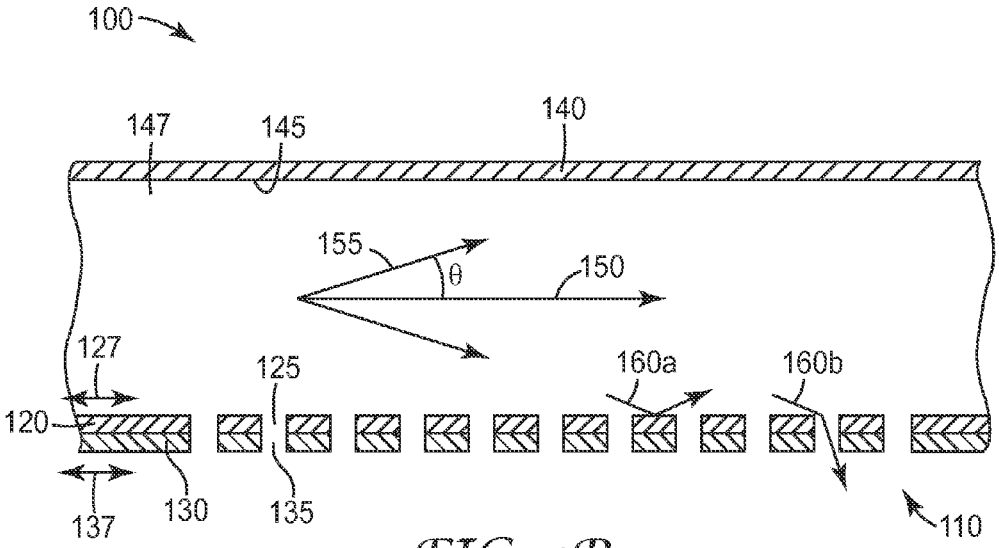

FIGS. 1A-1B shows a cross-section schematic of a switchable light extractor 110 disposed in a light duct 100, according to one aspect of the disclosure. The light duct 100 includes a light duct housing 140 having an interior reflective surface 145 that encloses a light duct cavity 147. A portion of the light duct housing 140 includes the switchable light extractor 110. The switchable light extractor 110 includes a first reflector 120 and a second reflector 130 that are slidably arranged next to each other. In some cases, first reflector 120 can move in a first direction 127 relative to the light duct housing 140. In some cases, second reflector 130 can move in a second direction 137 relative to the light duct housing 140. In some cases, both the first reflector 120 and the second reflector 130 can move in the first direction 127 and the second direction 137, respectively, relative to the light duct housing 140. Generally, the first direction 127 and the second direction 137 can be at any angle relative to the propagation direction 150, although they are both shown to be parallel to the propagation direction in FIGS. 1A-1B. In one particular embodiment, the light duct can be more effective by using very high efficiency reflectors such as, for example, Vikuiti™ Enhanced Specular Reflector (ESR) film available from 3M Company.

For those devices designed to transmit light from one location to another, such as a light duct, it is desirable that the optical surfaces absorb and transmit a minimal amount of light incident upon them while reflecting substantially all of the light. In portions of the device, it may be desirable to deliver light to a selected area using generally reflective optical surfaces and to then allow for transmission of light out of the device in a known, predetermined manner. In such devices, it may be desirable to provide a portion of the optical surface as partially reflective to allow light to exit the device in a predetermined manner, or as transparently switchable, as described herein.

Where multilayer optical film is used in any optical device, it will be understood that it can be laminated to a support (which itself may be transparent, opaque reflective or any combination thereof) or it can be otherwise supported using any suitable frame or other support structure because in some instances the multilayer optical film itself may not be rigid enough to be self-supporting in an optical device.

The first reflector 120 includes a first plurality of voids 125, and the second reflector 130 includes a second plurality of voids 135. It will be understood that the term "void" can be used to describe an actual physical aperture through first or second reflector 120, 130, as well as clear or transparent areas formed in the first or second reflector 120, 130 which do not substantially reflect light. The number and size of the first and second plurality of voids 125, 135, may be varied to control the amount of light transmitted. At one extreme, first and second plurality of voids 125, 135 may even constitute complete voids in one or both of the first and second reflectors 120, 130, although large voids may be undesirable to protect the interior of the light duct 100 from debris, dust, etc. In some cases, a transparent film (not shown) can be placed adjacent to second reflector 130 and opposite the light duct cavity 147 to protect the interior of the light duct from dust and other impurities that could affect the reflectivity of the surfaces within the light duct 100.

In one particular embodiment, each of the first and second plurality of voids, 125, 135 can be physical apertures, such as holes that pass either completely through, or through only a portion of the thickness of the respective first and second reflectors 120, 130. In one particular embodiment, each of the first and second plurality of voids, 125, 135, can instead by transparent regions such as windows. In either case, the first and second plurality of voids 125, 135 designate a region of the first and second reflector 120, 130, where light can pass through the respective reflector, rather than reflect from the surface. The voids can have any suitable cross-section, such as circular, elliptical, triangular, rectangular, polygonal, and the like.

The voids can be physical apertures that may be formed by any suitable technique including, for example, die cut, laser cut, molded, formed, and the like. The voids can instead be transparent windows that can be provided of many different materials or constructions. The areas can be made of multilayer optical film or any other transmissive or partially transmissive materials. One way to allow for light transmission through the areas is to provide areas in optical surface which are partially reflective and partially transmissive. Partial reflectivity can be imparted to multilayer optical films in areas by a variety of means.

In one aspect, areas may comprise multi-layered optical film which is uniaxially stretched to allow transmission of light having one plane of polarization while reflecting light having a plane of polarization orthogonal to the transmitted light, such as described, for example, in U.S. Pat. No. 7,147,903 (Ouderkirk et al.), entitled "High Efficiency Optical Devices". In another aspect, areas may comprise multi-layered optical film with has been distorted in selected regions, to convert a reflective film into a light transmissive film. Such distortions can be effected, for example, by heating portions of the film to reduce the layered structure of the film, as described, for example, in PCT Publication No. WO2010075357 (Merrill et al.), entitled "internally Patterned Multilayer Optical Films using Spatially Selective Birefringence Reduction".

The selective birefringence reduction can be performed by the judicious delivery of an appropriate amount of energy to the second zone so as to selectively heat at least some of the interior layers therein to a temperature high enough to produce a relaxation in the material that reduces or eliminates a preexisting optical birefringence, but low enough to maintain the physical integrity of the layer structure within the film. The reduction in birefringence may be partial or it may be complete, in which case interior layers that are birefringent in the first zone are rendered optically isotropic in the second zone. In exemplary embodiments, the selective heating is achieved at least in part by selective delivery of light or other radiant energy to the second zone of the film.

The relative motion of the first and second reflectors 120, 130 can at least partially align at least one of the first and second plurality of voids 125, 135, and this at least partial alignment can be used to extract a portion of the partially collimated light 155 travelling within a collimation angle θ of a light propagation direction 150 through the light duct cavity 147. In one particular embodiment, each of the first plurality of voids 125 and second plurality of voids 135 have the same size, shape, and distribution across the first and second reflectors 120, 130, respectively, and as a result, the at least partial alignment of the first and second plurality of voids 125, 135 means that there is at least a partial alignment for each of the voids. In one particular embodiment, at least one of the size, shape, and distribution of the first plurality of voids 125 and second plurality of voids 135 can be different, and as a result, only a portion will be aligned, as described elsewhere.

In one particular embodiment, partially collimated light 155 includes a cone of light having a propagation direction within an input light divergence angle θ from light propagation direction 150. The divergence angle θ of partially collimated light 155 can be symmetrically distributed in a cone around the first propagation direction 150, or it can be non-symmetrically distributed. In some cases, the divergence angle θ of partially collimated light 155 can range from about 0 degrees to about 30 degrees, or from about 0 degrees to about 25 degrees, or from about 0 degrees to about 20 degrees. In one particular embodiment, the divergence angle θ of partially collimated light 155 can be about 23 degrees, FIG. 1A shows an embodiment where the size, shape, and distribution of the first and second plurality of voids 125, 135, are the same, and the first and second reflectors 120, 130 are aligned so that none of the voids are in alignment. In this embodiment, the switchable light extractor 110 is in the closed position, and a first light beam 160*a* and a second light beam 160*b* of the partially collimated light 155 reflects from the first reflector 120, and the second reflector 130, respectively. In contrast, FIG. 1B shows an embodiment where the size, shape, and distribution of the first and second plurality of voids 125, 135, are the same, and the first and second reflectors 120, 130 are aligned so that all of the voids are in alignment. In this embodiment, the switchable light extractor 110 is in the fully open position, and a first light beam 160*a* of the partially collimated light 155 reflects from the first reflector 120, and a second light beam 160*b* of the partially collimated light 155 transmits through the aligned voids 125, 135 of the first and the second reflector 120, 130, respectively.

Figure 2:
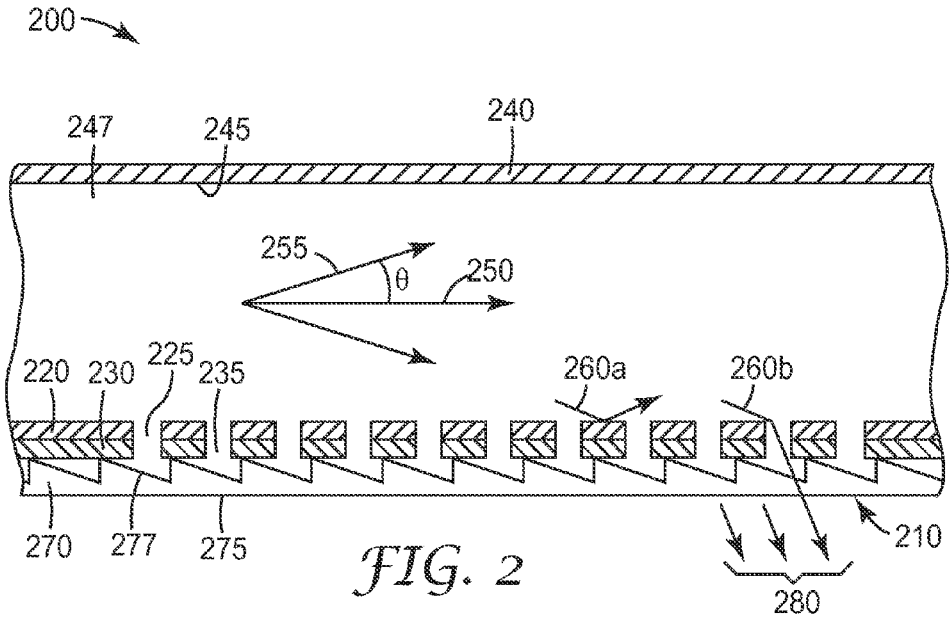
FIG. 2 shows a cross-section schematic of a light extractor.

FIG. 2 shows a cross-section schematic of a switchable light extractor 210 disposed in a light duct 200, according to one aspect of the disclosure. Each of the elements 220-255 shown in FIG. 2 correspond to like-numbered elements 120-155 shown in FIG. 1A, which have been described previously. For example, light duct housing 140 shown in FIG. 1A corresponds to light duct housing 240 shown in FIG. 2, and so on. In FIG. 2, switchable light extractor 210 further includes a microstructured film 270 having a series of prism faces 277 facing the second reflector 230, and a planar surface 275 opposite the prism faces 277. In one particular embodiment, microstructured film 270 can be referred to as a "turning film" such as, for example, Vikuiti™ Image Directing Films, available from 3M Company. In this embodiment, the switchable light extractor 210 is in the fully open position, and a first light beam 260*a* of the partially collimated light 255 reflects from the first reflector 220, and a second light beam 260*b* of the partially collimated light 255 transmits through the aligned voids 225, 235 of the first and the second reflector 220, 230, respectively. The transmitted second light beam 260*b* passes through the microstructured film 270 as redirected extracted light 280.

Figure 3:
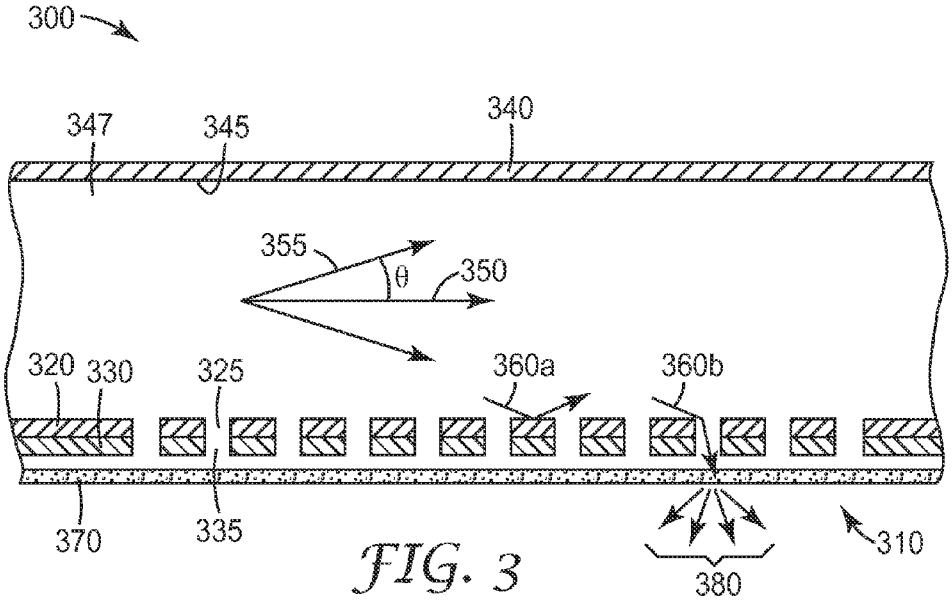
FIG. 3 shows a cross-section schematic of a light extractor.

FIG. 3 shows a cross-section schematic of a switchable light extractor 310 disposed in a light duct 300, according to one aspect of the disclosure. Each of the elements 320-355 shown in FIG. 3 correspond to like-numbered elements 120-155 shown in FIG. 1A, which have been described previously. For example, light duct housing 140 shown in FIG. 1A corresponds to light duct housing 340 shown in FIG. 3, and so on. In FIG. 3, switchable light extractor 310 further includes a diffuser film 370 facing the second reflector 3303. In one particular embodiment, diffuser film 370 can be any known suitable diffuser such as, for example, a surface diffuser, a volume diffuser and the like. Such diffusing films can serve to disperse the extracted light so that the illuminated room includes a more uniform light distribution. In this embodiment, the switchable light extractor 310 is in the fully open position, and a first light beam 360*a* of the partially collimated light 355 reflects from the first reflector 320, and a second light beam 360*b* of the partially collimated light 355 transmits through the aligned voids 325, 335 of the first and the second reflector 320, 330, respectively. The transmitted second light beam 360*b* passes through the diffuser film 370 as diffuse extracted light 380.

Figure 4A:
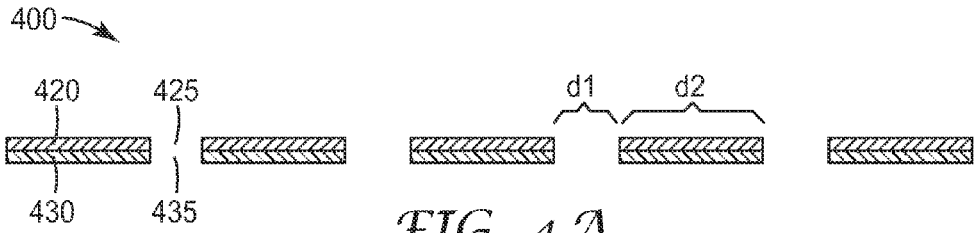
FIGS. 4A-4C shows a cross-section schematic of a light extractor.
Figure 4B:
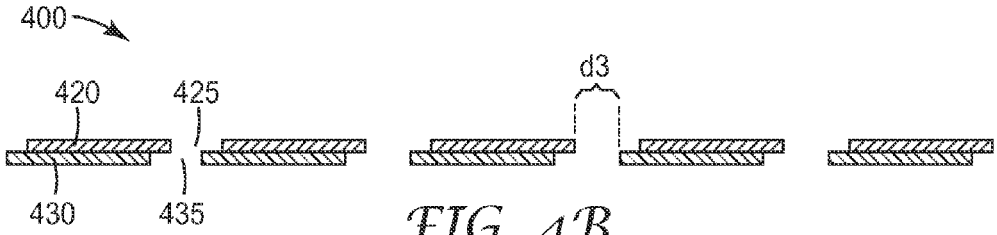
Figure 4C:
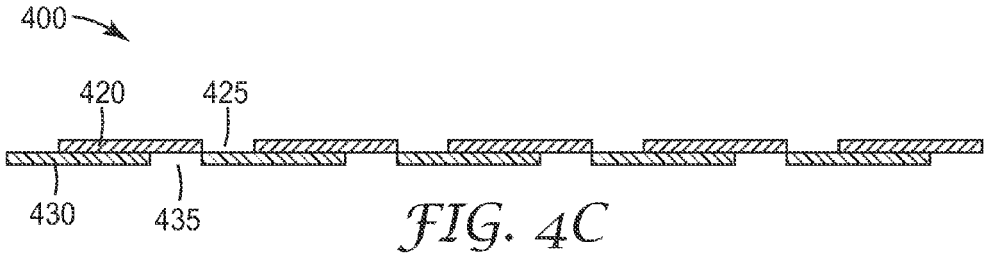

FIGS. 4A-4C shows a cross-section schematic of a light extractor 400, according to one aspect of the disclosure. In FIGS. 4A-4C, a first reflector 420 and a second reflector 430 have a similar size, shape, and distribution of a first and a second plurality of voids, 425, 435, respectively. In FIG. 4A, each of the first and second plurality of voids 425, 435 are in alignment. The aligned first and second plurality of voids 425, 435, each have a first characteristic dimension d1, and each of the voids is separated by a second characteristic dimension d2. In one particular embodiment, each of the voids can be circular in cross-section, and the first characteristic dimension d1 can be a diameter of the void. In this embodiment, second characteristic dimension d2 can be a separation between adjacent circular voids.

In one particular embodiment, each of the first and second characteristic dimensions d1, d2, can instead correspond to a cross-sectional area of voids and a cross-sectional area of reflector throughout the first and second reflector 420, 430, respectively. In this embodiment, the light extractor can be described in terms of a "percentage void area" that changes as the reflectors are slid relative to each other. The maximum open percentage as shown in FIG. 4A can be described as (d1/d2)×100%. In some cases, the maximum percent void area can range from about 10% to about 90%, or from about 20% to about 80%, or from about 30% to about 70%.

The light extracted through the plurality of voids can be varied by the relative alignment of the first and second reflector 420, 430, as shown in the progression from FIG. 4A to FIG. 4B to FIG. 4C. In FIG. 4B, a partial overlap of the voids reduces the percentage open void area to (d3/d2)×100%, which is less than the maximum percent void area described above, and in FIG. 4C, the first and second reflectors 420, 430 overlap such that there is zero percentage open void area (i.e., d3=0). The relative alignment can be controlled manually, or by mechanical or electronic techniques, as known to one of skill in the art.

Figure 4D:
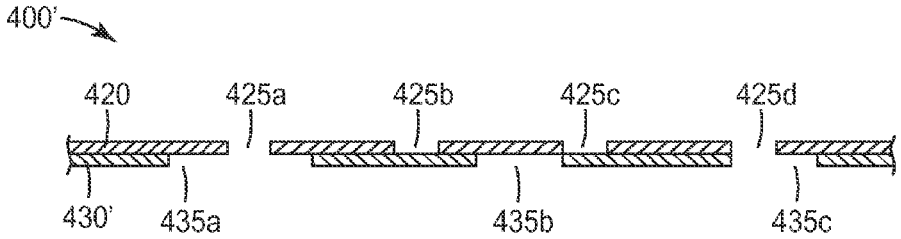
FIG. 4D shows a cross-section schematic of a light extractor.

FIG. 4D shows a cross-section schematic of a light extractor 400', according to one aspect of the disclosure. In FIG. 4D, a first reflector 420 includes a first plurality of voids 425*a*, 425*b*, 425*c*, 425*d* that are of uniform size, uniform shape, and are also uniformly distributed across the first reflector 420. A second reflector 430' includes a second plurality of voids 435*a*, 435*b*, 435*c*, that are of non-uniform size, optionally non-uniform shape, and are also non-uniformly distributed across the second reflector 430'. Such a varied combination of reflectors having different sizes, shapes, and distributions of voids can in some cases lead to a wider possible variation in the light extracted throughout different regions of the light extractor, as would be known to one of skill in the art.

Figure 5A:
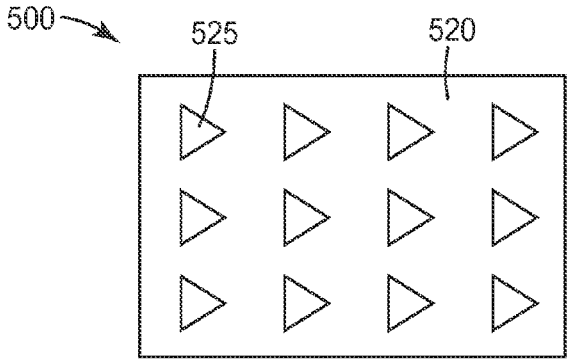
FIGS. 5A-5C shows a schematic of extractors having different shaped voids.
Figure 5B:
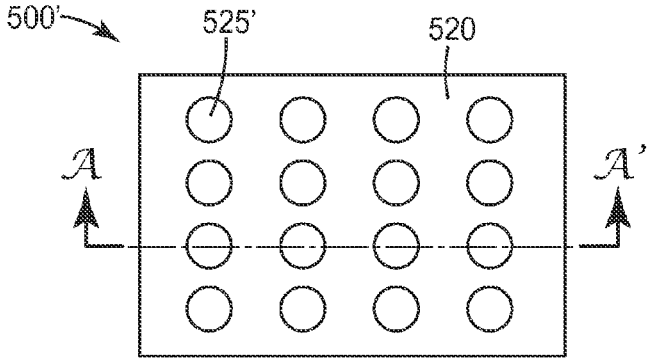
Figure 5C:
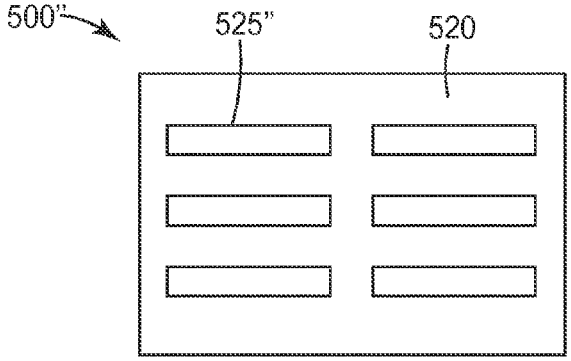

FIGS. 5A-5C shows a schematic of extractors having different shaped voids useable as extractor components, according to one aspect of the disclosure. It is to be understood that the reflectors shown in FIGS. 5A-5C are intended only to be representative of a small selection of possible void patterns and shapes. FIG. 5A shows an extractor sheet 500 having triangular voids 525 in reflector 520, FIG. 5B shows an extractor sheet 500' having circular voids 525' in reflector 520, and FIG. 5C shows an extractor sheet 500" having rectangular voids 525" in reflector 520. In one particular embodiment, each of the extractor sheets 500, 500', 500", can be paired with an identical extractor sheet. In one particular embodiment, each of the extractor sheets 500, 500', 500", can instead be paired with an extractor sheet having a completely different pattern of voids. In either case, the paired extractor sheets are slidably arranged relative to each other, as described elsewhere.

Figure 5D:
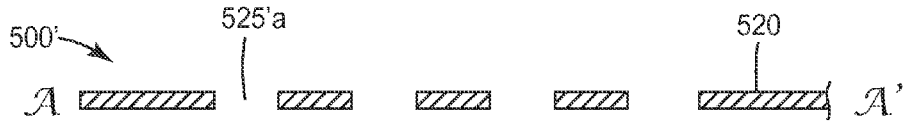
FIGS. 5D-5E shows a cross-section of the extractor of FIG. 5B.
Figure 5E:
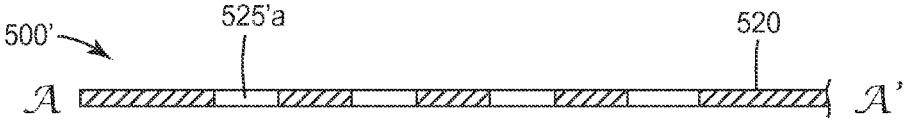

FIGS. 5D-5E shows a cross-section of the extraction sheet of FIG. 5B through line A-A', according to one aspect of the disclosure. In FIG. 5D, extractor sheet 500' includes voids 525*a*' that are physical apertures (i.e., holes) completely through reflector 520. In FIG. 5E, extractor sheet 500' includes voids 525*a*' that are transparent windows through reflector 520.

Figure 6:
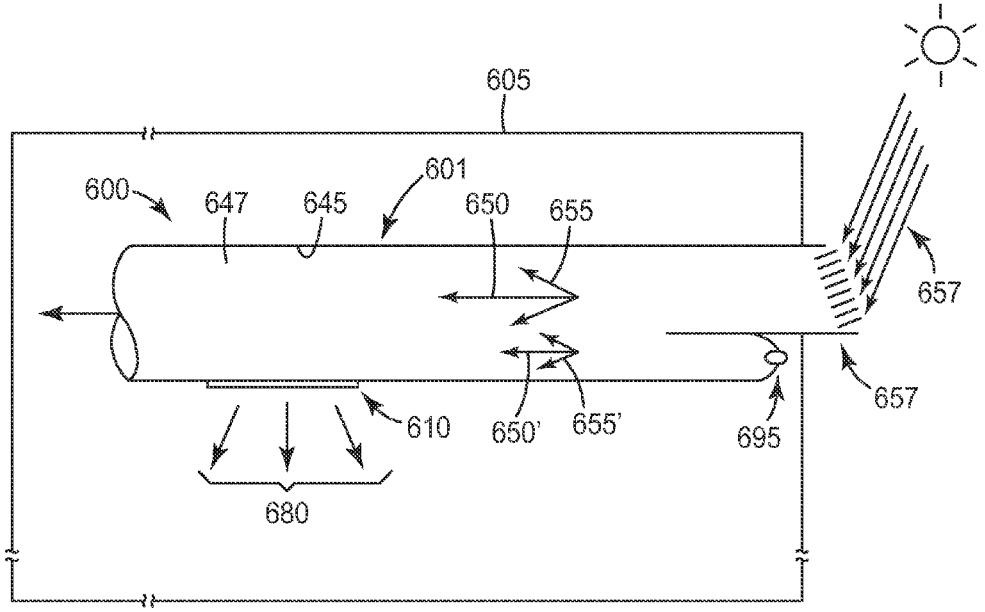
FIG. 6 shows a schematic of a lighting system.

FIG. 6 shows a schematic of a lighting system 600 within a building 605, according to one aspect of the disclosure. Optical devices such as lighting system 600 are typically used to transmit light between two locations and are commonly referred to as "light ducts." Such devices have a longitudinal axis and a cross-section transverse to that axis which forms a closed plane figure. Examples of some typical cross-section figures include circles, ellipses, polygons, closed irregular curves, triangles, squares, rectangles or other polygonal shapes. Any lighting system 600 having a closed plane figure transverse cross-section appears as two surfaces in a longitudinal cross-section as shown in FIG. 6 even though the lighting system may actually be formed from a single continuous optical surface.

Because the multilayer optical film according to the present invention used absorbs substantially none of the light incident upon it, light ducts constructed of multilayer optical film according to the present invention can extend for a relatively large distances without significant loss of throughput.

It is particularly advantageous to use the multilayer optical film with devices such as light ducts in which a large portion of the light travelling through the device approaches the surfaces of the device at shallow angles. The multilayer optical film described herein, is able to reflect light at shallow angles with the much the same efficiency as light approaching the film normal to the surfaces.

The lighting system 600 includes a light duct 601 having a highly-efficient mirror lined interior surface 645 surrounding a light duct cavity 647. The lighting system 600 further includes a daylight input section 690, which can include a collector/concentrator such as that described in, for example, co-pending U.S. Patent Application No. 61/373,357 (Corrigan et al.) filed Aug. 13, 2010, entitled "Concentrating Daylight Collector". The daylight input section 690 collects solar collimated light 657 and injects the light into a light duct 601 as partially collimated sunlight 655 travelling through light duct 601 in sunlight propagation direction 650. The lighting system optionally includes an artificial light source 695 that is disposed to inject partially collimated artificial light 655' into light duct 601 along an artificial light propagation direction 650'. The optional artificial light source 695 can be used to even out any fluctuations in the level of sunlight both during cloudy/overcast days, as well as provide light during evening hours. A switchable extractor 610 is positioned on the light duct 601 such that an extracted light 680 can leave the duct where desired. The switchable extractor 610 includes sections which are at least partially transmissive, thus allowing light to escape from the system where desired, as described elsewhere. The transmission mechanisms may include multilayer reflective polarizing sections, voids or any other mechanism as described with respect to the illustrative embodiments above.

Following are a list of embodiments of the present disclosure.

Item 1 is a switchable light extractor, comprising: a first reflector including a first plurality of voids; and a second reflector including a second plurality of voids, the second reflector disposed facing the first reflector, wherein the first and the second reflectors are slidably arranged so that at least one of the first plurality of voids can be at least partially aligned with at least one of the second plurality of voids.

Item 2 is the switchable light extractor of item 1, wherein at least one of the first reflector and the second reflector comprise a polymeric multilayer optical film.

Item 3 is the switchable light extractor of item 1 or item 2, wherein at least one of the first plurality of voids or the second plurality of voids comprise a physical aperture.

Item 4 is the switchable light extractor of item 3, wherein the physical aperture comprises through-holes.

Item 5 is the switchable light extractor of item 1 to item 4, wherein at least one of the first plurality of voids or the second plurality of voids comprises a transparent region.

Item 6 is the switchable light extractor of item 1 to item 5, wherein the transparent region comprises a deformed region.

Item 7 is the switchable light extractor of item 6, wherein the deformed region is a heat and/or pressure deformed region.

Item 8 is the switchable light extractor of item 1 to item 7, wherein the first reflector and the second reflector are immediately adjacent each other.

Item 9 is the switchable light extractor of item 1 to item 8, wherein a major portion of the first plurality of voids and the second plurality of voids can be at least partially aligned with each other.

Item 10 is the switchable light extractor of item 1 to item 9, further comprising a turning film disposed adjacent the second reflector and opposite the first reflector.

Item 11 is the switchable light extractor of item 10, wherein the turning film comprises a structured surface disposed adjacent the second reflector.

Item 12 is the switchable light extractor of item 1 to item 11, wherein at least one of the first reflector and the second reflector comprises a percentage void area between about 30% and about 70%.

Item 13 is the switchable light extractor of item 1 to item 11, further comprising a protective film disposed adjacent the second reflector.

Item 14 is a lighting system, comprising: a mirror-lined light duct; a light source disposed to inject light into the light duct; and the switchable light extractor according to item 1 to item 13, disposed so that the first reflector faces an interior of the mirror-lined light duct.

Item 15 is the lighting system of item 14, wherein a portion of the light injected into the mirror-lined light duct is capable of exiting the switchable light extractor through the at least partially aligned first plurality of voids and second plurality of voids, as an extracted light.

Item 16 is the lighting system of item 14 or item 15, wherein the light injected into the mirror-lined light duct is not capable of exiting the switchable light extractor unless the first plurality of voids and second plurality of voids are at least partially aligned.

Item 17 is the lighting system of item 14 to item 16, wherein the light source comprises natural light, artificial light, or a combination of natural light and artificial light.

Item 18 is a method of extracting light from a lighting system, comprising disposing the switchable light extractor according to item 1 or item 17 into a mirror-lined light duct; injecting light into the mirror-lined light duct; and sliding at least one of the first and second light reflectors to at least partially align the first plurality of voids and the second plurality of voids so as to generate an extracted light.

Item 19 is the method of item 18, further comprising disposing a turning film adjacent the second light reflector, the turning film capable of directing the extracted light in a predetermined direction.

Item 20 is the method of item 18 or item 19, further comprising disposing a diffuser adjacent the second light reflector.

Unless otherwise indicated, all numbers expressing feature sizes, amounts, and physical properties used in the specification and claims are to be understood as being modified by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

All references and publications cited herein are expressly incorporated herein by reference in their entirety into this disclosure, except to the extent they may directly contradict this disclosure. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A switchable light extractor, comprising:

a first reflector including a first plurality of voids, wherein the first reflector comprises a first reflective surface;

a second reflector including a second plurality of voids, wherein the second reflector comprises a second reflective surface, and wherein the second reflector is disposed facing the first reflector such that the first reflective surface and the second reflective surface face in the same direction; and a turning film disposed adjacent the second reflector and opposite the first reflector, the turning film comprising a structured surface having prism faces disposed facing toward the second reflector and a planar surface opposite the prism faces disposed facing away from the second reflector;

wherein the first reflector and the second reflector are slidably arranged so that at least one of the first plurality of voids at least partially overlies at least one of the second plurality of voids.

2. The switchable light extractor of claim 1, wherein at least one of the first reflector and the second reflector comprise a polymeric multilayer optical film.

3. The switchable light extractor of claim 1, wherein at least one of the first plurality of voids or the second plurality of voids comprise a physical aperture.

4. The switchable light extractor of claim 3, wherein the physical aperture comprises through-holes.

5. The switchable light extractor of claim 4, wherein the deformed region is a heat and/or pressure deformed region.

6. The switchable light extractor of claim 1, wherein at least one of the first plurality of voids or the second plurality of voids comprises a transparent region.

7. The switchable light extractor of claim 6, wherein the transparent region comprises a deformed region.

8. The switchable light extractor of claim 1, wherein the first reflector and the second reflector are immediately adjacent each other.

9. The switchable light extractor of claim 1, wherein a major portion of the first plurality of voids is at least partially aligned with the second plurality of voids.

10. The switchable light extractor of claim 1, wherein at least one of the first reflector and the second reflector comprises a percentage void area between about 30% and about 70%.

11. The switchable light extractor of claim 1, further comprising a protective film disposed adjacent the second reflector.

12. A lighting system, comprising:

a mirror-lined light duct;

a light source disposed to inject light into the mirror-lined light duct; and the switchable light extractor according to claim 1, disposed so that the first reflector faces an interior of the mirror-lined light duct.

13. The lighting system of claim 12, wherein a portion of the light injected into the mirror-lined light duct exits the switchable light extractor through the at least partially aligned first plurality of voids and second plurality of voids, as an extracted light.

14. The lighting system of claim 12, wherein the light injected into the mirror-lined light duct is not capable of exiting the switchable light extractor unless the first plurality of voids and second plurality of voids are at least partially aligned.

15. The lighting system of claim 12, wherein the light source comprises natural light, artificial light, or a combination of natural light and artificial light.

16. The lighting system of claim 12, wherein the first reflector is in a first plane, and the second reflector is in a second plane substantially parallel to the first plane, and wherein the first plane and the second plane are both substantially parallel to a propagation direction of the light injected into the mirror-lined light duct.

17. A method of extracting light from a lighting system, comprising:

disposing the switchable light extractor according to claim 1 into a mirror-lined light duct;

injecting light into the mirror-lined light duct; and sliding at least one of the first and second light reflectors to at least partially align the first plurality of voids and the second plurality of voids so as to generate an extracted light, wherein the turning film is capable of directing the extracted light in a pre-determined direction.

18. The method of claim 17, further comprising disposing a diffuser adjacent the second light reflector.

19. The switchable light extractor of claim 1, wherein the first reflector is in a first plane, and the second reflector is in a second plane substantially parallel to the first plane.

20. A lighting system, comprising:

a light duct housing comprising a reflective interior surface;

a light source disposed to inject light into the light duct housing along a propagation direction; and a switchable light extractor in a portion of the light duct housing, the switchable light extractor comprising:

a first reflective polymeric multilayer optical film in a first plane, wherein the first reflective polymeric multilayer optical film comprises a first plurality of voids, and wherein the first reflective polymeric multilayer optical film comprises a first reflective surface facing the reflective interior surface of the light duct housing;

a second reflective polymeric multilayer optical film in a second plane substantially parallel to the first plane, wherein the second reflective polymeric optical film comprises a second plurality of voids, and wherein the second reflective polymeric multilayer optical film comprises a second reflective surface facing the same direction as the first reflective surface of the first reflective polymeric multilayer film; and wherein the first reflective polymeric multilayer optical film and the second reflective polymeric multilayer optical film are slidably arranged relative to each other such that the first reflective multilayer optical film is moveable in the first plane and the second reflective polymeric multilayer optical film is moveable in the second plane to at least partially align at least one of the first plurality of voids with at least one of the second plurality of voids to control extraction of light from the light duct housing.

21. The lighting system of claim 20, further comprising a turning film disposed adjacent the second reflector and opposite the first reflector, the turning film comprising a structured surface having prism faces facing toward the second reflector and a planar surface opposite the prism faces facing away from the second reflector.

22. The lighting system of claim 20, further comprising a diffuser film facing the second reflector.

23. The lighting system of claim 20, wherein the first plane and the second plane are both parallel to the propagation direction of the light injected into the light duct housing.

* * * * *